United States Patent [19]

Sheridan et al.

[11] 4,388,896

[45] Jun. 21, 1983

[54] LUBRICATING SYSTEM FOR A TWO-CYCLE ENGINE

[75] Inventors: Stephen E. Sheridan; James M. Hundertmark, both of Fond du Lac, Wis.

[73] Assignee: Brunswick Corporation, Skokie, Ill.

[21] Appl. No.: 291,717

[22] Filed: Aug. 10, 1981

[51] Int. Cl.[3] ..... F01M 1/00
[52] U.S. Cl. ..... 123/73 AD
[58] Field of Search ..... 123/73 AD

[56] References Cited

U.S. PATENT DOCUMENTS

| | | | |
|---|---|---|---|
| 2,935,057 | 5/1960 | Perlewitz | 123/73 AD |
| 2,938,509 | 5/1960 | Carbonero | 123/73 AD |
| 3,929,110 | 12/1975 | Raikov et al. | 123/73 AD |

FOREIGN PATENT DOCUMENTS

| | | | |
|---|---|---|---|
| 503450 | 12/1954 | Italy | 123/73 AD |

*Primary Examiner*—Wendell E. Burns
*Attorney, Agent, or Firm*—O. T. Sessions

[57] ABSTRACT

The invention provides a remote oil tank (19) to supply oil to an oil reservoir (29) mounted on a two-cycle, crankcase compression engine (10) such as used for outboard motors. Crankcase pressure may be used to pressurize the remote tank (19) to move the oil.

10 Claims, 2 Drawing Figures

LUBRICATING SYSTEM FOR A TWO-CYCLE ENGINE

DESCRIPTION

1. Technical Field

This invention relates to internal combustion engines and, more particularly, to a lubricating system having a remote tank for supplying lubricant to a two-cycle engine.

2. Background Art

Prior lubrication systems for two-cycle engines have used a single pump to draw lubricant from a tank and supply it to the engine induction system, where it mixes with fuel and air. Since it is essential that there be no interruption in the lubricant flow while the engine is operating, the location of the lubricant tank in prior systems has been limited to positions where the pump would be self priming. Thus, for certain applications such as outboard motors, the required location of the tank has effectively limited the space available for the tank.

DISCLOSURE OF INVENTION

The invention provides a lubrication system for a two-cycle, crankcase compression engine. The lubricant system includes a lubricant tank, pressurized by a conduit from the engine crankcase. The pressure in the lubricant tank forces lubricant through a second conduit to supply lubricant to the engine. This arrangement permits the lubricant tank to be remotely located from the engine.

A lubricant reservoir mounted on the engine receives lubricant from the lubricant tank to assure an oil supply to the engine at all times, and particularly during start ups. The lubricant reservoir supplies lubricant to a metering pump which may conveniently meter lubricant to the inlet of the fuel pump.

A one-way or check valve in the conduit from the crankcase to the remote lubricant tank assures pressurization of the system, while a relatively small opening in parallel flow relationship to the check valve allows the system to depressurize when not in operation.

The invention thus provides an oil injection system with the convenience of a large capacity tank, which may be filled without removing the engine cowl. The lubricant reservoir mounted on the engine supplies lubricant to the metering pump, so that no prolonged interruption of the oil supply is possible. Delivery of the oil to the inlet of the fuel pump further provides for a more emulsified mixture of oil and gasoline.

BEST MODE FOR CARRYING OUT THE INVENTION

Figures 1, 2:
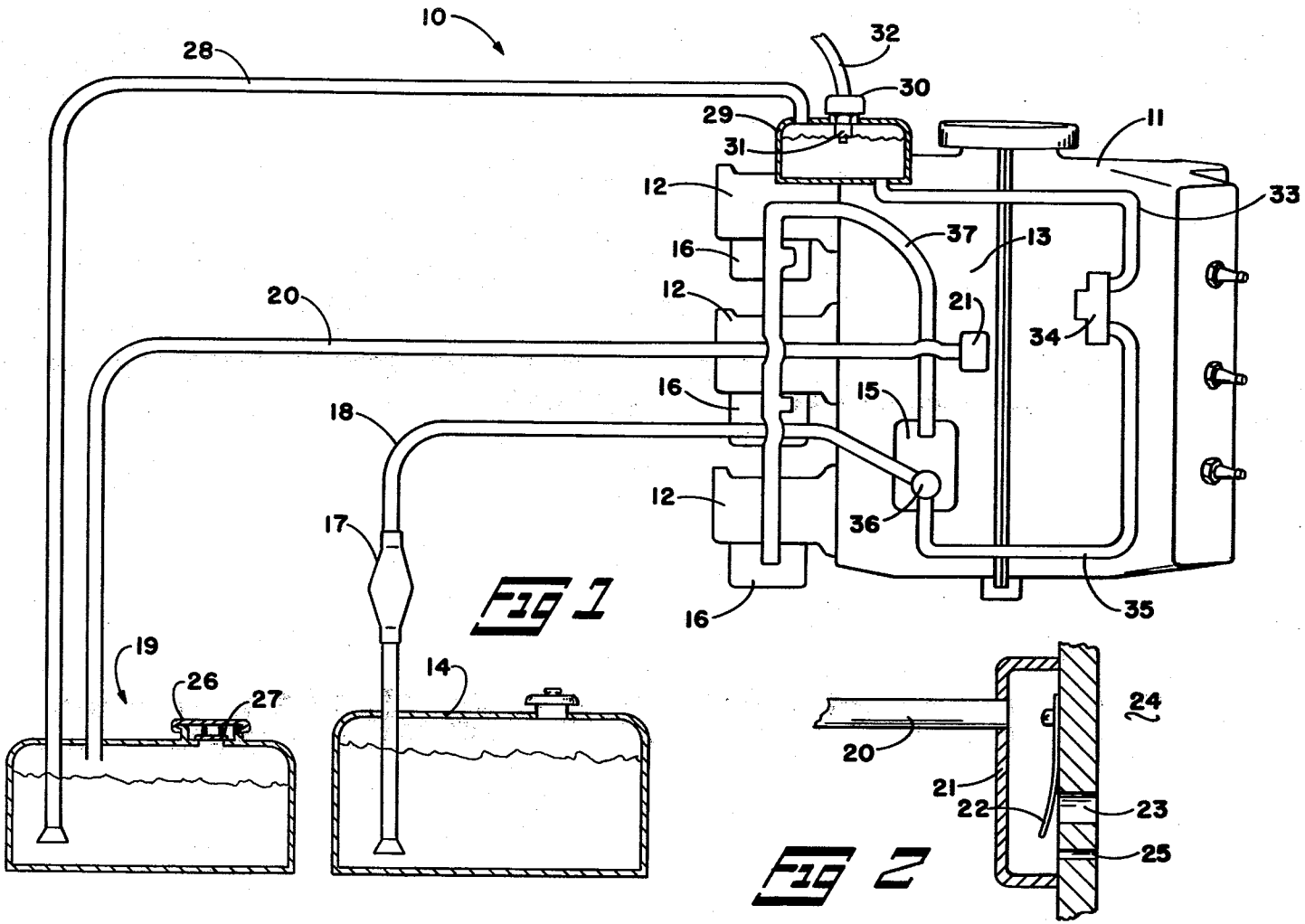
FIG. 1 is a schematic view of an engine, incorporating the lubricant system of the invention.
FIG. 2 is a sectional view illustrating the one-way valve mounted on the crankcase.

Shown in the drawings is a two-cycle crankcase compression engine 10, incorporating the lubricant system of the invention. The engine has a V-6 cylinder block 11 with three two-barrel carburetors 12 supplying fuel to the engine's crankcase compartments 13. Fuel, usually gasoline, from a remote fuel tank 14 is drawn from the tank 14 by a fuel pump 15, and supplied under pressure to the carburetor float bowls 16. The diaphragm operated fuel pump 15 is driven in conventional manner by pressure pulses from two of the crankcase chambers. A primer bulb 17 is provided in the fuel line 18 between the fuel tank 14 and the fuel pump 15 to allow the pump 15 to be manually primed.

To avoid the need for premixing fuel and lubricant, a separate remote oil tank 19 is provided. The oil tank 19 is pressurized by a line 20 opening into the top of the tank 19, and connected with one of the engine crankcase chambers through a valve housing 21. The valve housing 21 encloses a one-way reed valve 22 to prevent flow through the valve passage 23 to the crankcase chamber 24, and allows flow in the opposite direction. A small relief passage 25 allows flow past the valve to the crankcase chamber 24 to depressurize the tank 19 when the engine 10 is not operating. The relief passage 25 is significantly smaller than the valve passage 23. Thus, when the engine 10 is in operation, flow through the relief passage 25 is insignificant, when compared to flow through the valve passage 23. Though the relief passage 25 is illustrated as a passage parallel to the valve passage 23, it could readily be formed as a small hole through the reed valve member 22. A removable filler cap 26 is provided on top of the tank 19 to allow the tank 19 to be filled. The filler cap 26 preferably includes a pressure relief valve 27 to prevent any excess pressure build up within the tank 19.

The remote oil tank 19 is connected by a conduit 28 to supply an oil reservoir 29 mounted on the engine. The conduit 28 opens near the bottom of the oil tank 19, on one end, and into the oil reservoir 29 on the other. The oil reservoir 29 includes a filler cap 30 to allow the reservoir 29 to be initially filled, with the reservoir cap 30 providing a pressure seal. Preferably, a sensor 31 is mounted in the reservoir cap 30 to detect low oil levels in the reservoir 29, and transmit an electrical signal by cable 32 to a warning light or horn, not illustrated.

From the reservoir oil flows through a conduit 33 to an oil metering pump 34. The metering pump 34 is a positive displacement pump, having a variable volumetric displacement, available from Mikuni Kogyo Co., Ltd. The oil metering pump 34 is preferably driven by a worm gear on the engine crankshaft, and has its displacement controlled by a linkage to the engine throttle control, not illustrated. Thus, the metering pump output will be a function of engine speed and throttle opening.

In the preferred embodiment, the metered oil flows through a conduit 35 from the metering pump, directly to the inlet of the fuel pump. There, the oil mixes with incoming fuel from the fuel tank 14. The ratio of fuel to oil pumped by the fuel pump 15 will preferably range from 50:1 at wide open throttle, to 100:1 at idle. Because the oil is injected into the fuel system ahead of the fuel pump 15, the fuel and oil achieve a substantially uniform mixture by the time they reach the carburetors 12. As an alternative, however, the metering pump could provide a separate outlet for each engine cylinder to inject oil into the inlet manifold of each cylinder downstream from the carburetor.

To operate the system, the fuel tank 14 should be filled with gasoline, the remote lubricant tank 19 filled with oil or other appropriate lubricant and the lubricant reservoir 29 should be filled. As the engine is started, oil is fed to the metering pump 34, which delivers metered oil to the inlet 36 of the fuel pump 15. The fuel and oil mix in the fuel pump 15 and passage 37 leading to the carburetors 12, and are then mixed with air in the carburetors in a conventional manner. Simultaneously, the remote lubricant tank 19 is pressurized by its connection 20 with the engine crankcase 13. The pressure in the remote tank 19 then forces oil through the conduit 28 to replace the oil drawn from the oil reservoir 29 by the metering pump 34 and to pressurize the reservoir 29.

When the remote tank 19 has emptied, oil from the reservoir 29 mounted on the engine will continue to feed the oil pump 34. As the level of oil in the reservoir 29 drops, the low oil sensor 31 in the reservoir cap 30 will activate either an audible signal or a warning light when the oil supply reaches a level providing at least twenty minutes running time at wide open throttle. When the engine is stopped, the relief passage 25 allows the lubrication system to depressurize by allowing vapor to flow from the lubricant tank 19 to the engine crankcase.

The invention thus provides a lubrication system with the convenience of a large oil reservoir, which may be remotely located from the engine. The system is relatively low cost, convenient to use, and includes safeguards to avoid operation of the engine without oil.

We claim:

1. A lubrication system for a two-cycle, crankcase compression engine, comprising:

(A) a lubricant tank;

(B) a first conduit means connected from said lubricant tank to said engine for supplying lubricant to said engine;

(C) a second conduit means connected from the crankcase of said engine to said lubricant tank for pressurizing said tank, said lubricant being forced through said first conduit by the pressure in said tank;

(D) a lubricant reservoir mounted on said engine, and connected to said first conduit means to receive lubricant through said first conduit means; and (E) a metering pump, said metering pump connected to receive lubricant from said reservoir and to supply metered lubricant to said engine.

2. The system defined in claim 1 further comprising a fuel tank and a fuel pump having an inlet connected to said fuel tank and an outlet for supplying fuel to said engine, with said inlet further connected to said metering pump, whereby said fuel pump receives the output of said metering pump.

3. The system defined in claim 1 wherein said lubricant reservoir includes a sensor to sense low lubricant level in said reservoir.

4. The system defined in claim 1 wherein said second conduit means includes a one-way valve allowing flow from the crankcase to said lubricant tank.

5. The system defined in claim 4 wherein said second conduit means further includes an opening to allow depressurization of said remote tank when said engine is not operating.

6. The system defined in claim 5 wherein said opening is connected in parallel flow relationship to said one-way valve.

7. In a two-cycle, crankcase compression engine having a fuel tank, a fuel pump for delivering fuel from said fuel tank to the engine crankcase, a lubricant reservoir, and a lubricant pump for delivering lubricant from said reservoir to the crankcse, the improvement comprising:

(A) a remote lubricant tank;

(B) a first passage from said remote lubricant tank to said lubricant reservoir, said first passage having an opening near the bottom of said tank; and (C) a second passage connected to said crankcase and said tank, said passage having a valve in said passage to allow the passage of gases from said crankcase to said tank to pressurize said tank while said engine is operating to force lubricant from said tank through said second passageway to said lubricant reservoir.

8. The engine defined in claim 7 further comprising a vent to relieve pressure in said remote tank.

9. The engine defined in clain 8 wherein said vent has a smaller flow capacity than said valve.

10. The engine defined in claim 9 wherein said vent is connected to allow flow from said remote tank to said crankcase.

* * * * *